US006582210B2

(12) United States Patent
Sano et al.

(10) Patent No.: US 6,582,210 B2
(45) Date of Patent: Jun. 24, 2003

(54) SCROLL COMPRESSOR HAVING A COMPLIANT FRAME AND A GUIDE FRAME FOR THE ORBITING SCROLL

(75) Inventors: Fumiaki Sano, Tokyo (JP); Shin Sekiya, Tokyo (JP); Kiyoharu Ikeda, Tokyo (JP); Takeshi Fushiki, Tokyo (JP); Yoshihide Ogawa, Tokyo (JP); Teruhiko Nishiki, Tokyo (JP); Takashi Sebata, Tokyo (JP); Masao Tani, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/179,974

(22) Filed: Jun. 26, 2002

(65) Prior Publication Data

US 2003/0082064 A1 May 1, 2003

(30) Foreign Application Priority Data

Oct. 29, 2001 (JP) ..... 2001-330354

(51) Int. Cl.[7] ..... F04C 18/04
(52) U.S. Cl. ..... 418/55.1; 418/55.5
(58) Field of Search ..... 418/55.1, 55.5, 418/57

(56) References Cited

U.S. PATENT DOCUMENTS

| | | | | |
|---|---|---|---|---|
| 4,696,628 A | * | 9/1987 | Kimura et al. | 418/55.1 |
| 6,135,739 A | | 10/2000 | Ogawa et al. | 418/55.5 |
| 2002/0102175 A1 | | 8/2002 | Nishiki et al. | 418/55.5 |

FOREIGN PATENT DOCUMENTS

| | | |
|---|---|---|
| CN | 1042969 | 4/1999 |
| JP | 11-141470 | 5/1999 |
| JP | 2000-205152 | 7/2000 |
| JP | 2000-337276 | 12/2000 |

* cited by examiner

*Primary Examiner*—John J. Vrablik
(74) *Attorney, Agent, or Firm*—Oblon, Spivak, McClelland, Maier & Neustadt, P.C.

(57) ABSTRACT

According to a scroll compressor of the present invention, at least one of a diameter space between an upper fitting surface of the guide frame and an upper fitting surface of the compliant frame at an upper fitting part where the upper fitting surface of the guide frame contacts with the upper fitting surface of the compliant frame, and a diameter space between a lower fitting surface of the guide frame and a lower fitting surface of the compliant frame at a lower fitting part where the lower fitting surface of the guide frame contacts with the lower fitting surface of the compliant frame is set to be equal to or shorter than a diameter space between the rotor and the stator.

12 Claims, 4 Drawing Sheets

SCROLL COMPRESSOR HAVING A COMPLIANT FRAME AND A GUIDE FRAME FOR THE ORBITING SCROLL

BACKGROUND OF THE INVENTION

1. Field of the Invention

The present invention relates to a scroll compressor used for a refrigerating machine, an air conditioner and the like.

2. Description of the Related Art

FIG. 5 shows a longitudinal sectional view of a compression mechanism part of a conventional scroll type refrigerant compressor disclosed in Japanese Unexamined Patent Publication No. 2000-337276. In FIG. 5, a fixed scroll 1, a seat 1*a* of the fixed scroll 1, a spiral blade 1*b* of the fixed scroll 1, an orbiting scroll 2, a seat 2*a* of the orbiting scroll 2, and a spiral blade 2*b* of the orbiting scroll 2 are provided. An orbiting bearing 2*c* is provided at a central part of the surface of the orbiting scroll opposite to the surface where the spiral blade 2*b* of the orbiting scroll 2 exists. A thrust surface 2*d* is formed on the end of the surface where the orbiting bearing 2*c* is provided. The orbiting scroll 2 is connected with an eccentric part 4*a* of a main shaft 4 through the orbiting bearing 2*c*. The eccentric part 4*a* is off-center by r shown in FIG. 5 with respect to the center line of the main shaft 4, and the amount of r is specified by the following formula.

$$r=1/2P-1/2(To+Tf)$$

P: spiral pitch (distance between blade sides),

To: spiral blade thickness of orbiting scroll

Tf: spiral blade thickness of fixed scroll

The orbiting scroll 2 executes an orbiting motion to the fixed scroll 1 based on a rotation of the main shaft 4 and a rotation suppression by an Oldham coupling 6, which causes a fluid compression. The main shaft 4 is supported in the radial direction by a main bearing 3*b* having a sliding member between the main bearing 3*b* and a compliant frame 3.

A rotor 8 is fitted and engaged with the main shaft 4, and the main shaft 4 is driven by a motor rotation based on the rotor 8 and a stator 9. There is a space 10 between an external diameter 8*a* of the rotor 8 and an internal diameter 9*a* of the stator 9 in order to avoid the rotor 8 contacting the stator 9 during the rotation. A thrust surface 3*a* is formed on the compliant frame 3 which supports a thrust surface 2*d* of the orbiting scroll 2 in the axial direction. The compliant frame 3 supports a main shaft load generated during operation, at the main bearing 3*b* in the direction of radius. In order to support the load at a guide frame 5, an upper fitting surface 3*c* and a lower fitting surface 3*d* are formed on the compliant frame 3. The upper fitting surface 3*c* is fitted and engaged with an upper fitting surface 5*a* of the guide frame 5 in the radial direction with having a minute space, and the lower fitting surface 3*d* is fitted and engaged with a lower fitting surface 5*b* in the radial direction with having a minute space. The clearances (spaces) at the upper fitting surface and the lower fitting surface between the compliant frame and the guide frame are set to be almost equal.

With respect to the radial direction, the compliant frame 3 in operation moves in the direction of a load which the main bearing receives from the main shaft, by the amount of the clearance. The upper fitting surface 3*c* of the compliant frame 3 contacts the upper fitting surface 5*a* of the guide frame 5 in the load direction of the main bearing, and the lower fitting surface 3*d* of the compliant frame 3 contacts the lower fitting surface 5*b* of the guide frame 5 in the load direction of the main bearing. As the load direction of the main bearing continuously changes 360 degrees during one rotation, the compliant frame 3 performs a minute orbiting motion in the guide frame 5. In addition, as the compliant frame 3 shifts in the radial direction, the space 10 between the rotor and the stator is reduced by the amount of the shifting.

In the conventional scroll compressor, as stated above, the upper fitting surface 3*c* and the lower fitting surface 3*d* are formed on the compliant frame 3, and each of the upper fitting surface 3*c* and the lower fitting surface 3*d* is fitted and engaged with the upper fitting surface 5*a* or the lower fitting surface 5*b* on the guide frame 5, with having a space in the direction of radius. Then, the compliant frame 3 moves in the direction of the load received from the main bearing, by the amount of the space. Relating to this movement, the orbiting scroll interlocked through the main shaft and the bearing, also moves in the direction of radius. According as the compliant frame moves, the orbiting scroll moves by the amount of a clearance from the original rotation center, a side space between the swirl of the orbiting scroll and the swirl of the fixed scroll is extended. As the swirl of the orbiting scroll makes the side space extend with respect to the swirl of the fixed scroll, a leak from the swirl side in the scroll compression chamber is increased, which causes performance deterioration. Further, as the compliant frame 3 moves depending upon the space, the axis of the rotor interlocked with the main shaft also moves, which causes a contact problem of the external diameter of the rotor with the internal diameter of the stator.

Though the clearances between the compliant frame and the guide frame at the upper and lower fitting surfaces are set up to be almost equal, it is difficult to make the clearances at the upper and lower completely equal in every scroll compressor made in mass production. Therefore, the clearances at the upper fitting surface and the lower fitting surface are different in the range of a specific allowance. In some cases, the compliant frame contacts the guide frame at either the upper fitting surface or the lower fitting surface and does not contact at the other surface during operation, which causes a change of vibrations of the axial system and a change of noises of the axial system, a performance fall based on increasing of the contact of the spiral blade top, and an increase of wear of the contact part at the blade top.

Moreover, the compliant frame 3 in operation moves in the direction of a load which the main bearing receives from the main shaft, with respect to the radial direction, by the amount of the clearance. The upper fitting surface 3*c* of the compliant frame 3 contacts the upper fitting surface 5*a* of the guide frame 5 in the load direction of the main bearing, and the lower fitting surface 3*d* of the compliant frame 3 contacts the lower fitting surface 5*b* of the guide frame 5 in the load direction of the main bearing. As the load direction of the main bearing continuously changes 360 degrees during one rotation, the compliant frame 3 performs a minute orbiting motion in the guide frame 5. However, when the compliant frame 3 itself performs a rotational movement to the guide frame, there is a problem that a loss friction is generated at the part where the compliant frame 3 contacts with the upper and lower fitting surfaces 5*a* and 5*b* of the guide frame 5 and wear is also generated. Further, there is a problem that thickness of oil film of the main bearing is reduced and a load faculty of the bearing is also decreased because the relative rotation rate of the main bearing of the compliant frame and the main shaft falls.

In order to solve these problems, a rotation prevention structure for regulating the rotation of the compliant frame is formed between the guide frame and the compliant frame in the conventional scroll compressor. This rotation prevention structure is composed of combination of a reamer pin and a reamer hole, and regulates the rotation of the compliant frame by being associated with the reamer pin inserted in the guide frame. However, as a clearance between a diameter of the reamer pin and a diameter of the reamer hole is small, the state occurs that only the reamer pin receives a gas compression load during operation, which causes a problem of a smooth minute orbiting motion being impeded within the guide frame of the compliant frame and wear of the reamer pin and the reamer hole being increased. Furthermore, when the rotation prevention mechanism composed of a plurality of combinations of a reamer pin and a reamer hole is used, the number of moving times of discontinuous contact points increases during one rotation, which causes a problem of the increase in noise. Moreover, in the state where there is a space between the reamer pin and the reamer hole of the compliant frame and there is a space between the reamer pin and the reamer hole of the guide frame, since the reamer pin inclines to the reamer hole, the reamer pin partially contacts the reamer hole in the state of slanting contact at the entrance part of the hole. Therefore, it has a problem that wear of both the reamer pin and the reamer hole is increased.

It is an object of the present invention to solve the above problems and to obtain a scroll compressor of high reliability and high efficiency with few leaks of the compression chamber. It is another object of the present invention to obtain a scroll compressor structure of high quality which can retain stable operations in the long run even in the mass-production. Furthermore, it is another object of the present invention to obtain a scroll compressor structure of high reliability in which a trouble, such as a contact of a rotation portion and a fixed portion, does not occur in the long-term use that may change the operation state.

SUMMARY OF THE INVENTION

According to one aspect of the present invention, a scroll compressor includes:

a fixed scroll provided in a hermetic container, having a spiral blade on a seat;

an orbiting scroll provided in the hermetic container, having a spiral blade on a seat, where the spiral blade of the orbiting scroll forms a compression chamber by being together with the spiral blade of the fixed scroll;

a motor provided in the hermetic container, having a rotor connected to a main shaft for rotating the orbiting scroll and a stator for giving a rotation force to the rotor;

a compliant frame provided in the hermetic container, having a thrust bearing for supporting the orbiting scroll in the axial direction, and a main bearing for supporting the main shaft in the radial direction which drives the orbiting scroll; and a guide frame provided in the hermetic container, having an internal circumferential side contact surface and an external circumferential side contact surface, for supporting a contact surface of the compliant frame in the radial direction at the internal circumferential side contact surface which contacts with the contact surface of the compliant frame, with having a space between the contact surface of the compliant frame and the internal circumferential side contact surface of the guide frame, wherein the space between the contact surface of the compliant frame and the internal circumferential side contact surface of the guide frame is set to be equal to or shorter than a space being a length difference between an external diameter of the rotor and an internal diameter of the stator.

According to another aspect of the present invention, a scroll compressor includes:

a fixed scroll provided in a hermetic container, having a spiral blade on a seat;

an orbiting scroll having a spiral blade on a seat, where the spiral blade of the orbiting scroll forms a compression chamber by being together with the spiral blade of the fixed scroll;

a motor provided in the hermetic container, having a stator and a rotor for giving a rotation force to a main shaft which drives the orbiting scroll;

a compliant frame provided in the hermetic container, having a thrust bearing for supporting the orbiting scroll in the axial direction, a main bearing for supporting the main shaft in the radial direction, and two contact surfaces which independently exist, that is a first fitting surface and a second fitting surface, on an external circumference of the compliant frame;

a guide frame provided in the hermetic container, having two contact surfaces which independently exist, that is a first fitting surface and a second fitting surface, on an internal circumference of the guide frame, which are formed to be contacted with each of the two contact surfaces of the compliant frame, and the guide frame supporting the compliant frame in the radial direction at the two contact surfaces;

a first space existing at a first contact part where the first fitting surface of the guide frame contacts with the first fitting surface of the compliant frame; and a second space existing at a second contact part where the second fitting surface of the guide frame contacts with the second fitting surface of the compliant frame, wherein at least one of the first space and the second space is set to be equal to or shorter than a space being a length difference between an external diameter of the rotor and an internal diameter of the stator.

According to another aspect of the present invention, a scroll compressor includes:

a fixed scroll provided in a hermetic container, having a spiral blade on a seat;

an orbiting scroll provided in the hermetic container, having a spiral blade on a seat, where the spiral blade of the orbiting scroll forms a compression chamber by being together with the spiral blade of the fixed scroll;

a motor provided in the hermetic container, having a rotor connected to a main shaft for rotating the orbiting scroll and a stator for giving a rotation force to the rotor;

a compliant frame provided in the hermetic container, having a thrust bearing for supporting the orbiting scroll in an axial direction and a main bearing for supporting the main shaft in a radial direction which rotates the orbiting scroll;

a guide frame provided in the hermetic container, having a contact surface which contacts with a contact surface of the compliant frame, for supporting the compliant frame by contacting the contact surface of the guide frame with the contact surface of the compliant frame; and a reamer pin provided in the hermetic container, having two ends one of which is inserted in a reamer hole located close to the contact surface and provided in at least one of the compliant frame and the guide frame, for preventing a rotation of the compliant frame by being contacted with the other of the compliant frame and the guide frame, and the reamer pin having a space between the reamer pin and the reamer hole at a contact part where the reamer pin contacts with the reamer hole, wherein the space between the reamer pin and the reamer hole at the contact part is set to be longer than a space between the contact surface of the guide frame and the contact surface of the compliant frame.

According to another aspect of the present invention, a scroll compressor includes:

a fixed scroll provided in a hermetic container, having a spiral blade on a seat;

an orbiting scroll having a spiral blade on a seat, where the spiral blade of the orbiting scroll forms a compression chamber by being together with the spiral blade of the fixed scroll;

a motor provided in the hermetic container, having a stator and a rotor for giving a rotation force to a main shaft which drives the orbiting scroll;

a compliant frame provided in the hermetic container, having a thrust bearing for supporting the orbiting scroll in the axial direction, a main bearing for supporting the main shaft in the radial direction, and two contact surfaces which independently exist, that is a first fitting surface and a second fitting surface, on an external circumference of the compliant frame;

a guide frame provided in the hermetic container, having two contact surfaces which independently exist, that is a first fitting surface and a second fitting surface, on an internal circumference of the guide frame, which are formed to be contacted with each of the two contact surfaces of the compliant frame, and the guide frame supporting the compliant frame in the radial direction at the two contact surfaces;

a first space existing at a first contact part where the first fitting surface of the guide frame contacts with the first fitting surface of the compliant frame;

a second space existing at a second contact part where the second fitting surface of the guide frame contacts with the second fitting surface of the compliant frame;

a reamer pin provided in the hermetic container, having two ends; and a reamer hole provided on at least one of a guide frame plane in the radial direction between the first fitting surface and the second fitting surface of the guide frame and a compliant frame plane in the radial direction between the first fitting surface and the second fitting surface of the compliant frame, wherein one of the two ends of the reamer pin is inserted in the reamer hole for preventing rotation of the compliant frame, and a space between the reamer pin and the reamer hole at a contact part where the reamer pin contacts with the reamer hole is set to be longer than each of the first space and the second space between the guide frame and the compliant frame.

The above-mentioned and other objects, features, and advantages of the present invention will be made more apparent by reference to the following detailed description when taken in conjunction with the accompanying drawings.

EMBODIMENTS

Embodiment 1

Figure 1:
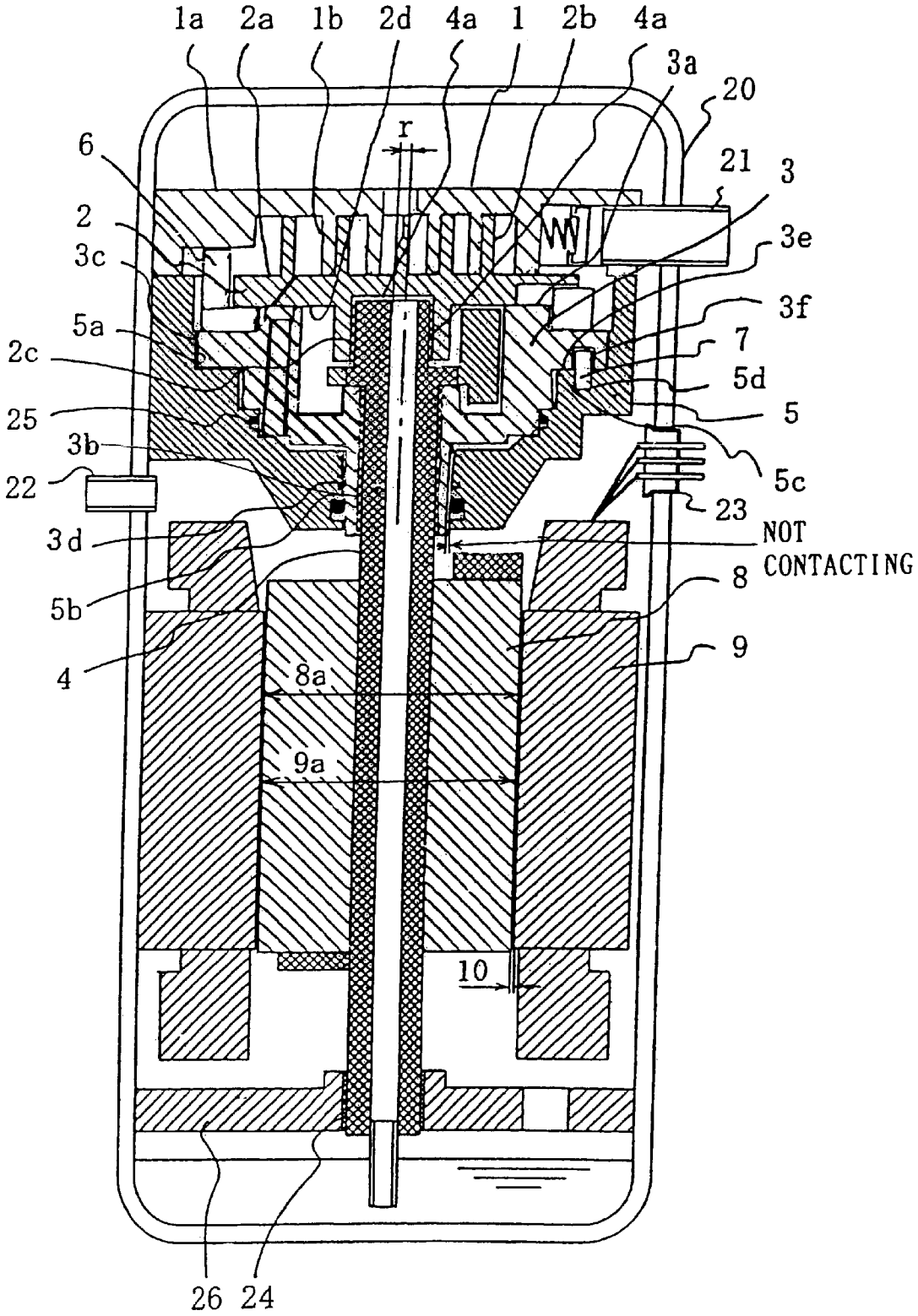
FIG. 1 shows a sectional view of a scroll compressor according to the present invention.

Preferred embodiments of the present invention will now be explained with reference to FIGS. 1 through 4, wherein the same numerical references as those of the conventional scroll compressor are given to the same parts or units, and descriptions of them are omitted. FIG. 1 shows a longitudinal section view of a compression mechanism part of a scroll type refrigerant compressor according to Embodiment 1. In FIG. 1, the following is provided: a fixed scroll 1 which is fixed to a hermetic container 20, a seat 1*a* of the fixed scroll 1, a spiral blade 1*b* of the fixed scroll 1, an orbiting scroll 2, a seat 2*a* of the orbiting scroll 2, and a spiral blade 2*b* of the orbiting scroll 2. An orbiting bearing 2*c* is provided at a central part of the surface of the orbiting scroll 2 opposite to the surface where the spiral blade 2*b* exists. A thrust surface 2*d* is formed on the end of the surface where the orbiting bearing 2*c* is provided. The orbiting scroll 2 is connected with an eccentric part 4*a* of a main shaft 4, forming an orbiting part, through the orbiting bearing 2*c*. The orbiting scroll 2 executes an orbiting motion to the fixed scroll 1 based on rotation of the main shaft 4 and rotation suppression by an Oldham coupling 6, which causes a fluid compression in a compression chamber formed by combination of the spiral blade 1*b* of the fixed scroll 1 and the spiral blade 2*b* of the orbiting scroll 2.

The main shaft 4 is supported in the radial direction by a main bearing 3*b* having a sliding member between the main bearing 3*b* and a compliant frame 3. The following is also shown in FIG. 1: the main shaft eccentric part 4*a* forming an orbiting axial part, a guide frame 5 supporting the compliant frame 3, a reamer pin 7, a rotor 8 being a motor for rotating the main shaft 4, a stator 9 fixed to the hermetic container 20 and giving driving force to the rotor 8, a space 10 being a length difference between an internal diameter 9*a* of the stator 9 being a fixed part of the motor and an external diameter 8*a* of the rotor 8 being a rotation part of the motor, a suction tube 21 for supplying refrigerant of low-temperature and low-pressure to a compression chamber, a discharge tube 22 discharging compressed refrigerant of high-pressure in the hermetic container 20 to a refrigeration cycle, a terminal part 23 for making an electric connection of a motor etc., and a lower bearing 24 provided at a sub frame 26 supporting the main shaft 4 at the opposite side of the main bearing 3*b*. When the main bearing 3*b* can support the rotation part, that is the orbiting scroll 2, the rotor 8 of the motor, etc. the lower bearing 24 can be omitted. The refrigerant which circulated through the external refrigeration cycle is sucked from the suction tube 21 into a compression chamber inside the hermetic container 20 of the compressor. Then, the refrigerant in the state of high-temperature and high-pressure is blown off from a discharging place at the upper center into the container, and discharged to the refrigeration cycle from the discharge tube 22. The main structure of a scroll compressor of a horizontal shaft is the same as that of FIG. 1, and the rotation part including the orbiting scroll 2 is supported by the main bearing 3*b* and the lower bearing 24. Though an oil reservoir is shown near the bottom of FIG. 1, the oil reservoir is located at the side (in the axial direction) of the hermetic container 20 in the horizontal shaft case. Therefore, in the horizontal shaft case, the structure of an oil pump leading lubricating oil from the oil reservoir to each bearing differs from the case of FIG. 1.

Further, the following is shown in FIG. 1: an upper fitting surface (fitting cylindrical surface) 3*c* of the compliant frame located facing an upper fitting surface 5*a* of the guide frame and supported in the radial direction by the guide frame with having a space, a lower fitting surface (fitting cylindrical surface) 3*d* of the compliant frame located facing a lower fitting surface 5*b* of the guide frame and supported in the radial direction by the guide frame with having a space, a radial direction plane 3*e* of the compliant frame located facing a radial direction plane 5*c* of the guide frame and supported in the axial direction by the guide frame with having a space, and a reamer hole 5*d* of the guide frame. In this article, the fitting surface indicates a side surface of a cylinder, where a contact action is performed. The compliant frame 3 is put on the guide frame 5 fixed to the hermetic container 20. Intermediate pressure from the compression chamber is introduced into space partitioned up and down (in the case of FIG. 1) by a seal ring 25. Consequently, the compression chamber of the orbiting scroll 2 is pushed up through the compliant frame 3, a thrust surface 3*a* of the compliant frame and the thrust surface 2*d* of the orbiting scroll. By dint of this, leak of the compressed refrigerant from the both spiral blades of the fixed scroll 1 and the orbiting scroll 2 can be suppressed. Therefore, an efficient apparatus can be obtained. A thrust bearing is composed of the thrust surface of the compliant frame and the thrust surface of the orbiting scroll.

In the structure of FIG. 1, the thrust surface 3*a* is formed on the compliant frame 3 supported in the axial direction by the guide frame 5. The compliant frame 3 supports a main shaft load generated during operation in the radial direction, at the main bearing 3*b*. In order to support the load at the guide frame 5, the upper fitting surface 3*c* and the lower fitting surface 3*d* are formed on the compliant frame 3. The upper fitting surface 3*c* is fitted and engaged with the upper fitting surface 5*a* of the guide frame 5 in the radial direction with having a minute space, and the lower fitting surface 3*d* is fitted and engaged with the lower fitting surface 5*b* in the radial direction with having a minute space. At least one of the clearances at the upper fitting surface and the lower fitting surface between the compliant frame and the guide frame is set to be equal to or shorter than the space between the diameters of the rotor and the stator. The structure has been described above where the compliant frame is supported by the guide frame in the radial direction at the upper and lower two parts: an upper fitting part formed by a contact surface (contact cylindrical surface) which consists of the upper fitting surface 5*a* of the guide frame and the upper fitting surface 3*c* of the compliant frame, and a lower fitting part formed by a contact surface which consists of the radial direction plane 5*c*, the lower fitting surface 5*b*, of the guide frame and the lower fitting surface 3*d* of the compliant frame. However, there is no necessity of restricting to the two upper and lower parts. Even in the case of making the two upper and lower parts be one part, or even in the case of parts equal to or more than two being provided, a trouble such as a contact can be prevented by dint of making the diameter clearance between the upper and the lower fitting surfaces equal to or shorter than the space of the motor which means the diameter clearance. By means of including a machining allowance in this size comparison, it is possible to obtain mass-production articles of good quality even if the accuracy is not raised in vain. Furthermore, even if the contact surfaces are not formed by the surfaces of the cylinders, and even if one of the contact surfaces is formed by a supporting object of wave or a sectional object, it is naturally acceptable as long as the load of the rotating shaft can be supported in the structure. By dint of this structure, as the trouble based on each part contacting can be prevented, the structure maintaining a good quality condition in long-term use can be obtained. In the case of the machine of a horizontal shaft and having much down flexure, the eccentric amount can naturally be included.

With respect to the radial direction, the compliant frame 3 in operation moves in the direction of a load which the main bearing 3*b* receives from the main shaft 4, by the amount of the clearance. Relating to this movement, the orbiting scroll 2 fitted and engaged through the main shaft 4 and the orbiting bearing 2*c* also moves in the radial direction. As the spiral blade 2*b* of the orbiting scroll makes a side space extend with respect to the spiral blade 1*b* of the fixed scroll, a leak from the spiral blade side in the scroll compression chamber is increased, which caused performance fall. Therefore, it is preferable to have a small clearance amount for the movement as less as possible. Further, when the compliant frame 3 moves, the axis of the rotor 8 of the motor fitted and engaged with the main shaft 4 also moves, which causes a contact problem of the external diameter of the rotor 8 with the internal diameter of the stator 9. Therefore, for the purpose of avoiding the contact problem, if at least one of the clearances at the upper fitting surface and the lower fitting surface between the compliant frame 3 and the guide frame 5 is set to be equal to or shorter than the space between the diameters of the rotor and the stator, it is possible to obtain the structure of a scroll compressor of high reliability.

Estimating the amount of movement of the orbiting scroll in the radial direction based on the clearance at the fitting surfaces of the compliant frame 3 and the guide frame 5, the distance (eccentric amount) between the orbiting axial part of the main shaft and the center of the main shaft is set to be greater than an orbiting radius specified by the forms of the spiral blade of the fixed scroll and the orbiting scroll, and set to be within the range not exceeding a half of a sum of three clearances of a diameter clearance of the orbiting bearing, a diameter clearance of the main bearing, and a minimum diameter clearance of the fitting surface of the compliant frame and the guide frame. Namely, the eccentric part 4*a* is off-center by r shown in FIG. 1 with respect to the center line of the main shaft 4, and the amount of r is set up by adding an amount of $\alpha(+\alpha)$ to r0 specified by the formula below.

$$r0=1/2P\ 1/2(To+Tf)$$

P: spiral pitch, To: spiral blade thickness of orbiting scroll, Tf: spiral blade thickness of fixed scroll $r=r0+\alpha$, $0<=\alpha<=1/2$(diameter clearance of the orbiting bearing+diameter clearance of the main bearing+diameter minimum clearance of the fitting surface of the compliant frame and the guide frame)

The upper limit value of the eccentric amount $r0+\alpha$ is specified to be the maximum value by which it is possible to move in the radial direction by the amount of space of the bearing and to move in the radial direction by the amount of space of the compliant frame and the guide frame, and the shaft is not locked, even if the spiral side of the orbiting scroll and the spiral side of the fixed scroll interfere by the shaft rotation. The lower limit value of a is set to be 0 as the minimum value by which performance does not fall. Thus, by means of setting up the eccentric amount as stated above, it is possible to reduce the spiral side space between the orbiting scroll and the fixed scroll by the estimated amount of the movement of the orbiting scroll in the radial direction based on the clearance at the fitting surface of the compliant frame and the guide frame. Accordingly, the scroll compressor of high performance can be obtained. Relating to the diameter minimum clearance between the two fitting surfaces, the value of the clearance is considered to be the limit by which locking is not executed. Therefore, if there are two fitting parts, the part having the most difficult condition, meaning the smaller size part to be easily locked, should be selected. In addition, this condition is also applied to the scroll of a horizontal shaft.

Figure 2:
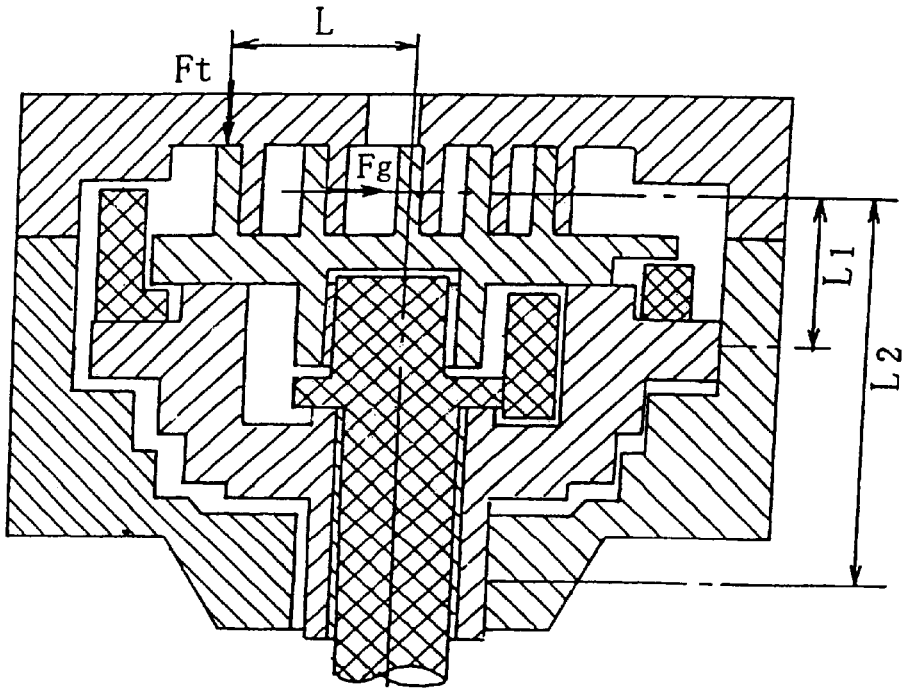
FIG. 2 illustrates a force balance given to a compression mechanism part of a scroll compressor according to the present invention in the case of one of the upper and the lower fitting surface of the scroll compressor contacting.

FIG. 2 shows a longitudinal sectional view of a compression mechanism part of a scroll type refrigerant compressor. In FIGS. 1 and 2, the fixed scroll 1, the seat 1*a* of the fixed scroll 1, the spiral blade 1*b* of the fixed scroll 1, the orbiting scroll 2, the seat 2*a* of the orbiting scroll 2, and the spiral blade 2*b* of the orbiting scroll 2 are provided. The orbiting bearing 2*c* is provided at a central part of the surface of the orbiting scroll opposite to the surface where the spiral blade 2*b* of the orbiting scroll 2 exists. The thrust surface 2*d* is formed on the end of the surface where the orbiting bearing 2*c* is provided. The orbiting scroll 2 is connected with the eccentric part 4*a* of the main shaft 4 through the orbiting bearing 2*c*. The eccentric part 4*a* is off-center by r shown in the figure with respect to the center line of the main shaft 4. FIG. 2 illustrates a force balance given to the compression mechanism part in the case of one of the upper and the lower fitting surface of the compliant frame 3 and the guide frame 5 contacting.

In FIG. 2, Fg indicates a gas compression load in the radial direction which acts on the orbiting scroll, L1 indicates a distance from a reaction force point in the radial direction to an action point of gas compression load Fg in the radial direction acting on the orbiting scroll in the case of the upper fitting surfaces of the compliant frame 3 and the guide frame 5 contacting, L2 indicates a distance from a reaction force point in the radial direction to an action point of gas compression load Fg in the radial direction acting on the orbiting scroll in the case of the lower fitting surfaces of the compliant frame 3 and the guide frame 5 contacting, Ft indicates a contact force of the spiral blade point of the orbiting scroll or the fixed scroll, and L indicates a distance with respect to the radial direction between the action position of Ft and the axis of the compliant frame. In the structures of FIG. 1 and FIG. 2, in order to maintain the balance relation of moments of the gas compression load Fg during operation, the reaction force during operation, and the spiral blade point contact force Ft, the moment balance formula is realized in the compliant frame 3 as follows:

When the upper fitting surfaces contact:

$$Fg*L1=Ft*L \quad (1)$$

$$Ft=Fg*L1/L \quad (2)$$

When the lower fitting surfaces contact:

$$Fg*L2=Ft*L \quad (3)$$

$$Ft=Fg*L2L \quad (4)$$

In the above formula, if it is needed to compare the spiral blade point contact force Ft in the case of contacting at the upper fitting surface with the spiral blade point contact force Ft in the case of contacting at the lower fitting surface, it is enough to compare the formula (2) with the formula (4). As L2>L1 in the formula, it is clear that the spiral blade point contact force Ft in the case of the lower fitting surface contacting is larger than that in the upper fitting surface contacting case. Thus, because the spiral blade contact force increases in the case of contacting only at the lower fitting surface, performance falls much and the spiral blade contact part wears much in the case of contacting only at the lower fitting surface than the case of the upper fitting surface contacting case. Then, what is necessary is to make the clearance at the upper fitting surface smaller than the clearance at the lower fitting surface in order to make the upper fitting surface contact first. Namely, the contact surface at the side of not the motor but the compression chamber is made to contact first. This relation is the same in a horizontal shaft machine. By dint of this, the efficiency can be increased without making an excessive spiral blade point contact force which causes a wear increase.

With respect to the radial direction, the compliant frame 3 in operation moves in the direction of a load which the main bearing 3*b* receives from the main shaft 4, by the amount of the clearance. The upper fitting surface 3*c* of the compliant frame 3 contacts the upper fitting surface 5*a* of the guide frame 5 in the load direction of the main bearing, and the lower fitting surface 3*d* of the compliant frame 3 contacts the lower fitting surface 5*b* of the guide frame 5 in the load direction of the main bearing. As the load direction of the main bearing continuously changes 360 degrees during one rotation, the compliant frame 3 performs a minute orbiting motion in the guide frame 5. However, when the compliant frame 3 itself performs a rotational movement to the guide frame, there is a problem that a friction loss is generated at the part where the compliant frame 3 contacts with the upper and lower fitting surfaces 5*a* and 5*b* of the guide frame 5 and wear is also generated. Further, there is a problem that thickness of oil film of the main bearing 3*b* is reduced and a load faculty of the bearing is also decreased because the relative rotation speed of the main bearing 3*b* of the compliant frame 3 and the main shaft 4 falls. As countermeasures for these problems, the clearances at the upper and the lower fitting parts, that is the contact surfaces of the compliant frame 3 and the guide frame 5, are decided.

The orbiting scroll 2 executes an orbiting motion to the fixed scroll 1 based on a rotation of the main shaft 4 and a rotation suppression by the Oldham coupling 6, which causes a fluid compression. The main shaft 4 is supported in the radial direction by the main bearing 3*b* having a sliding member between the main bearing 3*b* and the compliant frame 3.

The thrust surface 3*a* is formed on the compliant frame 3 which supports the thrust surface 2*d* of the orbiting scroll 2 in the axial direction. The compliant frame 3 supports a main shaft load generated during operation, at the main bearing 3*b* in the radial direction. In order to support the load at the guide frame 5, the upper fitting surface 3*c* and the lower fitting surface 3*d* are formed on the compliant frame 3. The upper fitting surface 3*c* is fitted and engaged with the upper fitting surface 5*a* of the guide frame 5 in the radial direction with having a minute space, and the lower fitting surface 3*d* is fitted and engaged with the lower fitting surface 5*b* in the radial direction with having a minute space. The clearance of the upper fitting part at the upper fitting surfaces of the compliant frame 3 and the guide frame 5 is set to be smaller than that of the lower fitting part at the lower fitting surfaces of the compliant frame 3 and the guide frame 5.

With respect to the radial direction, the compliant frame 3 in operation moves in the direction of a load which the main bearing 3*b* receives from the main shaft 4, by the amount of the clearance. The upper fitting surface 3*c* of the compliant frame 3 comes close to the upper fitting surface 5*a* of the guide frame 5 in the load direction of the main bearing, and the lower fitting surface 3*d* of the compliant frame 3 comes close to the lower fitting surface 5*b* of the guide frame 5 in the load direction of the main bearing. Since the space at the upper fitting part is smaller than the space at the lower fitting part, although the upper fitting part contacts and gives anti-force to the compliant frame 3, the lower fitting part maintains the state where it does not contact. Therefore, the spiral blade point contact force Ft, as shown in the above formula ②, can maintain a small value as compared with the case where it contacts at the lower fitting part (formula ④). Then, it is possible to solve the problem of the performance fall and the increase in wear of the spiral blade point which is accompanied by the increase in the contact force of the spiral blade point. In addition, as it is clear by the formula ①, when the upper fitting surfaces contact, the spiral blade point contact force Ft can be reduced in proportion that the distance L1, which is the distance between the reaction force point in the radial direction and the action point of the gas compression load Fg in the radial direction acting on the orbiting scroll becomes less. It is dynamically ideal that the reaction force point in the radial direction is located near the gas compression load part of the scroll spiral blade as close as possible. Namely, the form is dynamically ideal where the fitting surface is located at the central position of the height of the spiral blade of the orbiting scroll or the fixed scroll, and the reaction force point in the radial direction corresponds with the action point of the gas load acting on the spiral blade.

Figure 3A:
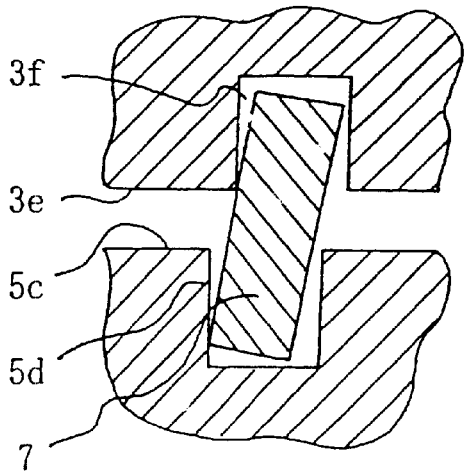
FIG. 3A shows a sectional view of a rotation prevention structure using a reamer pin which is not pressed, of a scroll compressor according to the present invention.
Figure 3B:
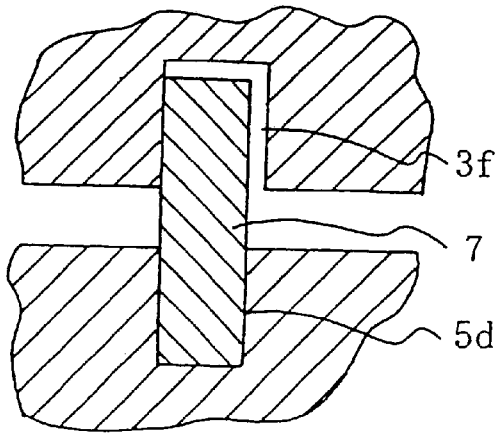
FIG. 3B shows a sectional view of a rotation prevention structure using a reamer pin which is pressed, of a scroll compressor according to the present invention.

Now, the measures against a rotation of a scroll compressor of frame compliant type is described. FIGS. 3A and 3B illustrate a rotation prevention structure by using a reamer pin, according to the present invention. In the scroll compressor, as shown in FIG. 1, a plane is provided in the radial direction between the upper fitting surface 5*a* and the lower fitting surface 5*b* of the guide frame 5, the reamer hole 5*d* is provided on this plane, the reamer pin 7 is inserted into the reamer hole 5*d*. Also, a plane is provided in the radial direction between the upper fitting surface 3*c* and the lower fitting surface 3*d* of the compliant frame 3, and a reamer hole 3*f* is provided on the plane facing the reamer hole 5*d* of the guide frame 5. The rotation prevention structure which regulates a rotation of the compliant frame 3 by being contacted with the reamer pin 7 inserted in the guide frame 5 is composed of combination of the reamer pin 7 and the reamer holes 3*f* and 5*d*. If the diameter clearance of the reamer pin 7 and the reamer hole 3*f* or 5*d* is smaller than the diameter clearance at the upper or lower fitting surface of the compliant frame 3 and the guide frame 5, the state occurs where only the reamer pin 7 receives the gas compression load generated in operation. Then, a smooth minute orbiting motion of the compliant frame 3 within the guide frame 5 is prevented, and wear of the reamer pin 7 and the reamer holes 3*f* and 5*d* is increased. Furthermore, even when the diameter clearance of the reamer pin 7 and the reamer hole 3*f* or 5*d* is larger than the diameter clearance at the upper or lower fitting surface of the compliant frame 3 and the guide frame 5, a discontinuous contact point movement is generated once in one rotation for the combination of the reamer pin 7 and the reamer hole 3*f* or 5*d*. Therefore, when the rotation prevention mechanism composed of a plurality of combinations of the reamer pin 7 and the reamer holes 3*f* and 5*d* is used, the number of movement times of the discontinuous contact point in one rotation increases, which causes the increase in noise.

FIG. 3A or 3B shows a sectional view of the rotation prevention structure using the reamer pin. In FIG. 3A or 3B, the plane 3*e* in the radial direction of the compliant frame, the reamer hole 3*f* of the compliant frame, the plane 5*c* in the radial direction of the guide frame, the reamer hole 5*d* of the guide frame, and the reamer pin 7 are shown. FIG. 3A shows the state where the reamer pin 7 is not pressed to the reamer holes 3*f* and 5*d* because the diameter space of the reamer pin 7 is smaller than the diameter space of the reamer holes 3*f* and 5*d*. In this case, since the reamer pin 7 inclines in the reamer holes 3*f* and 5*d*, the reamer pin 7 partially contacts the entrance part of the holes, and a contact part pressure is increased, which causes wear of both the reamer holes 3*f* and 5*d* and the reamer pin 7. FIG. 3B illustrates the state where the reamer pin 7 is pressed to the reamer hole 5*d* of the guide frame and there is a specific diameter space between the reamer pin 7 and the reamer hole 3*f* of the compliant frame. In this case, since the reamer pin 7 is pressed to the reamer hole 5*d* of the guide frame, the reamer pin 7 does not incline during operation, and since the reamer pin 7 contacts the reamer hole 3*f* in parallel, the slanting contact of the reamer pin 7 partially contacting the reamer hole 3*f* or 5*d* can be prevented and wear of the reamer pin and the reamer holes does not increase.

A diameter clearance of the reamer pin 7 and the reamer hole 3*f* or 5*d* indicates a diameter length difference between the diameter of the reamer pin 7 and the diameter of the reamer hole 3*f* or 5*d*. A total of the diameter clearances of the reamer pin 7 and the reamer holes 3*f* and 5*d* indicates a value calculated by adding a clearance (length) between the reamer pin 7 and the reamer hole 3*f* to a clearance (length) between the reamer pin 7 and the reamer hole 5*d*. When the total of the diameter clearances of the reamer pin 7 and reamer holes 3*f* and 5*d* is larger than the minimum value of the space at the upper or lower fitting part of the compliant frame 3 and the guide frame 5, the state of the reamer pin 7 supporting all the gas compression load during operation does not occur, and an excessive force is not loaded on the reamer pin 7 and the reamer holes 3*f* and 5*d*. Therefore, the problem, such as a wear increase, a performance fall, or a noise increase, brought by the state that the action of the orbiting scroll becomes unstable because of the movement of the contact point of the fitting surface of the compliant frame becoming discontinuous, can be resolved. Thus, according to the present invention, the above problem does not occur since the total of the diameter clearances of the reamer pin 7 and the reamer holes 3*f* and 5*d* is set to be larger than the minimum value of the space at the upper or lower fitting part of the compliant frame 3 and the guide frame 5. In the above, although the structure of providing the reamer holes in both the compliant frame and the guide frame has been explained, it is enough to provide a reamer hole having the space stated above in at least one of the compliant frame 3 and the guide frame 5. In this case, the structure can be freely chosen. For example, the structure of fixing the reamer pin in another side can be chosen.

Figure 4A:
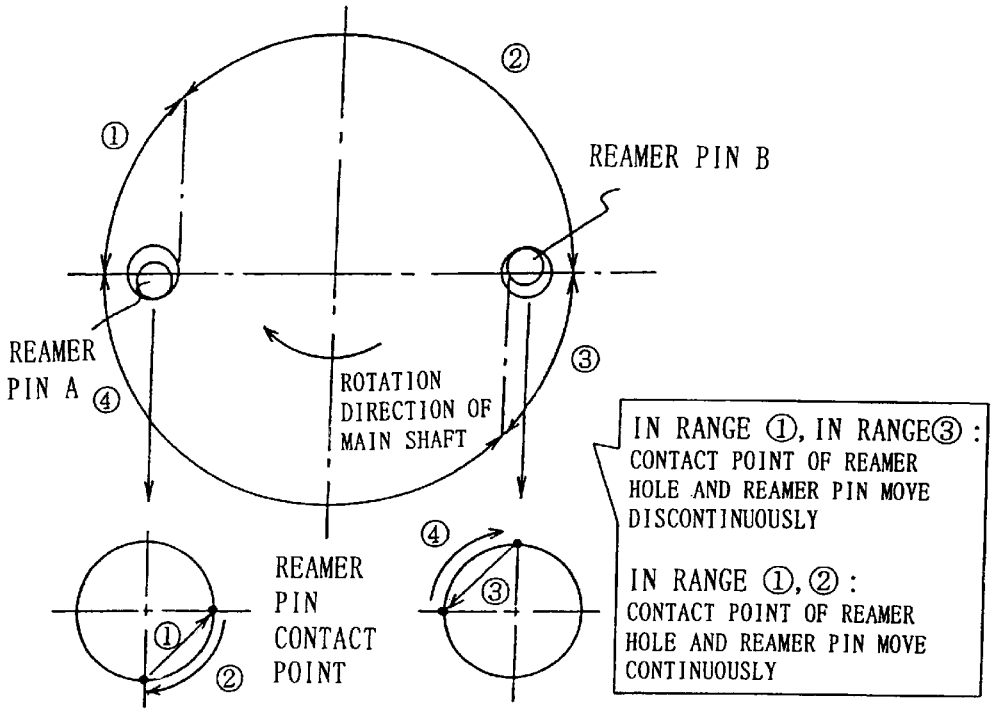
FIG. 4A illustrates a contact point of a fitting part of a compliant frame and a reamer pin being a rotation prevention mechanism, according to the present invention.
Figure 4B:
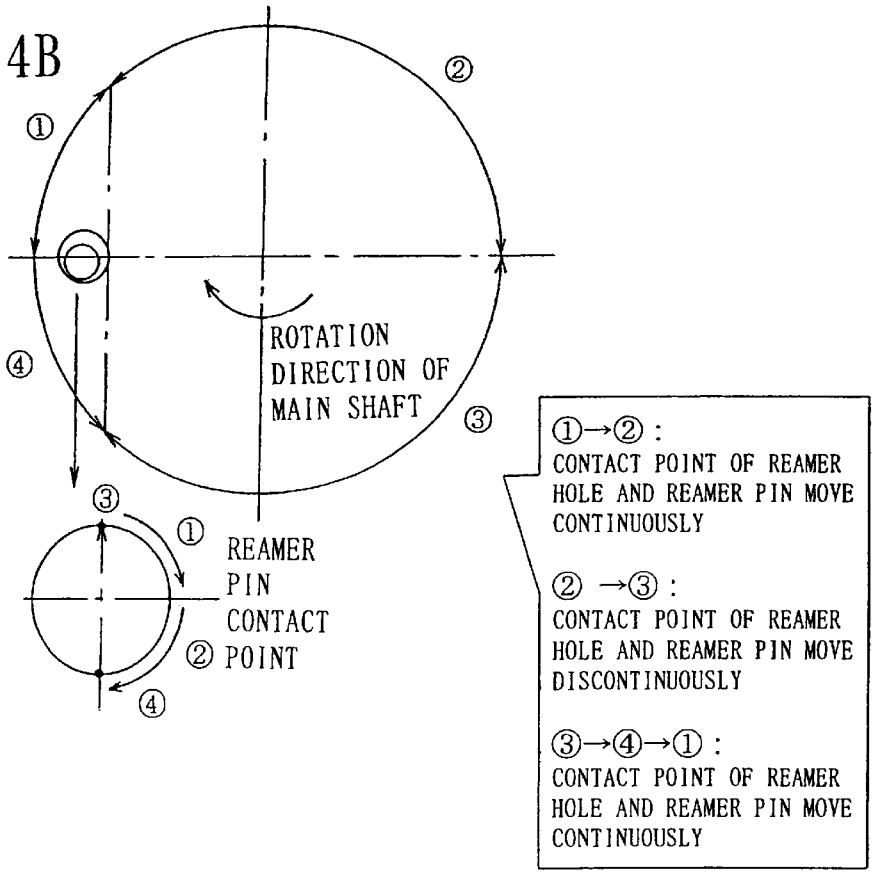
FIG. 4B illustrates a contact point of a fitting part of a compliant frame and a reamer pin being a rotation prevention mechanism, according to the present invention.
Figure 5:
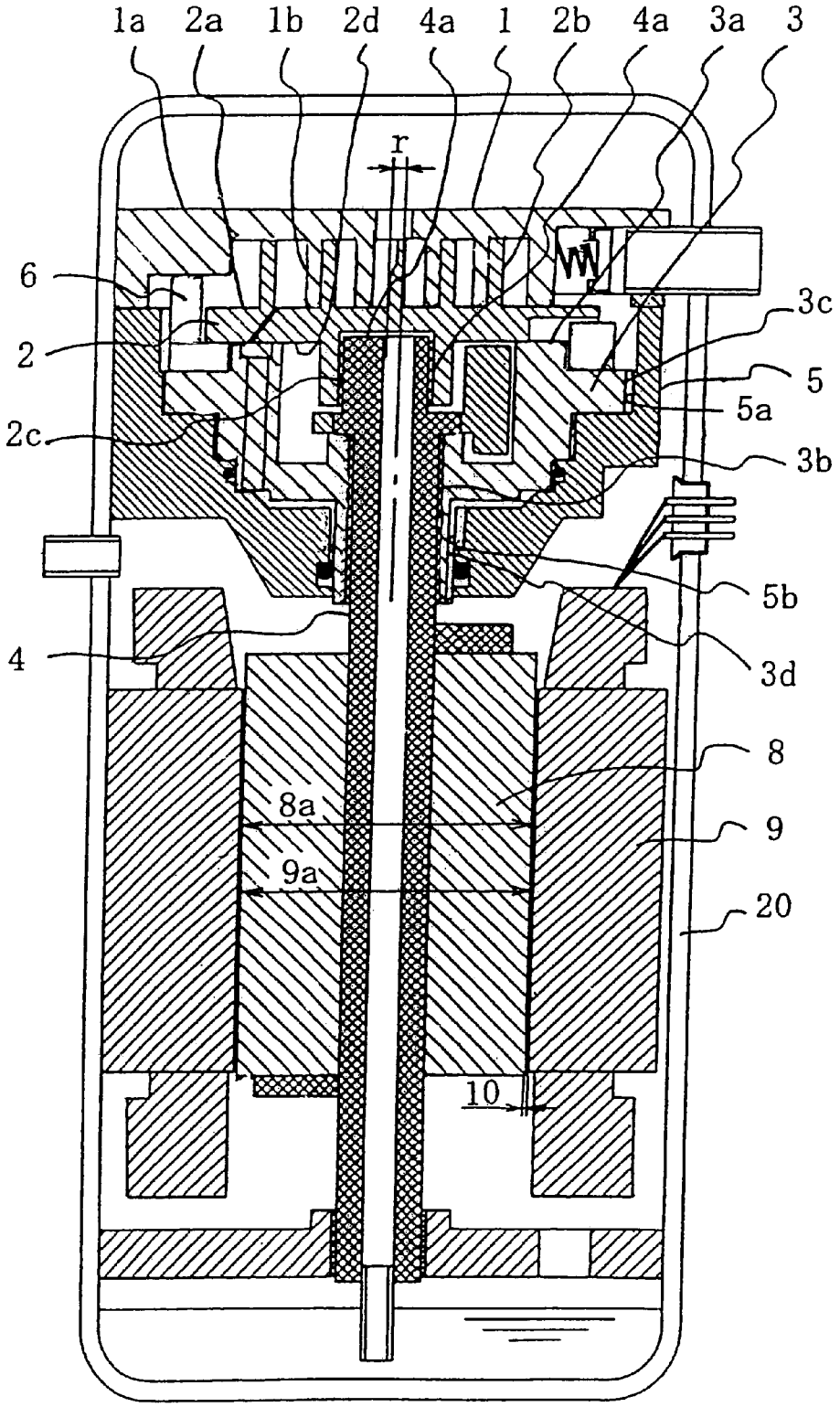
Fig. 5 RELATED ART
FIG. 5 shows a longitudinal sectional view of a compression mechanism part according to a conventional scroll compressor.

FIGS. 4A and 4B show the fitting part of the compliant frame 3 and the contact point of the reamer pin 7 being the rotation prevention mechanism. As the load direction of the main bearing of the scroll compressor according to the present invention continuously changes 360 degrees during one rotation because a gas compression load is generated during the rotation of the main shaft, the compliant frame 3 performs a minute orbiting motion in the guide frame 5. Then, the position of the contact point, in the radial direction, of the reamer pin 7 and the reamer holes 3*f* and 5*d* being the rotation prevention mechanism also moves in proportion to the rotation of the main shaft. FIG. 4A shows the position of the contact point in the radial direction in the case of two reamer pins, and FIG. 4B shows the position of the contact point in the radial direction in the case of one reamer pin. The numbers ①, ②, ③, and ④ in the figure show the movement range of the contact point of the fitting part, and the reamer pin contact illustration in the figure shows movement of the contact point of the reamer pin 7. In FIG. 4A, the contact point of the reamer pin A discontinuously moves once as ①→②→① for every rotation of the main shaft 4, and the contact point of the reamer pin B discontinuously moves once as ③→④→③ for every rotation of the main shaft 4. In the rotation prevention mechanism of two reamer pins, since the discontinuous movement of the contact points of the pin A and the pin B is generated with having a gap of 180 degree based on the rotation angle of the main shaft 4, the discontinuous movement of the reamer pin contact point occurs twice during one rotation of the main shaft.

On the other hand, in the case of the rotation prevention mechanism of one reamer pin, the discontinuous movement of the contact point on the reamer pin in the radial direction is only once during one rotation of the main shaft as shown in FIG. 4B. By means of composing the rotation prevention structure of the guide frame 5 of combination of one reamer pin and reamer holes, it is possible to make the movement of the discontinuous contact point in the radial direction of the reamer pin and the reamer holes minimum. Thus, the scroll compressor of high performance and low noise, whose compliant frame's action is stabilized, can be obtained. However, in the case of one reamer pin, the contact point becomes discontinuous in the specific direction of the axis, so that there is a possibility of generating an axial system vibration and unusual sounds. In such a case, it may be desirable to provide reamer pins in symmetrical rotation angle positions as shown in FIG. 4A. The case in which the reamer pin 7 is provided in the plane part in the radial direction of the compliant frame 3 or the guide frame 5 has been explained above. For the purpose of preventing a rotation, it is also acceptable to have the reamer hole not on the plane in the radial direction but on the both sides' contact surface, that is the fitting part in the perpendicular direction, and to make the direction of the axis of the reamer pin in the radial direction as a result. Even in this structure case, as long as the total of the diameter clearances of the reamer pin 7 and reamer holes 3*f* and 5*d* is set to be larger than the minimum value of the space at the upper or lower fitting part of the compliant frame 3 and the guide frame 5, no problem stated above occurs. As for the relation between the reamer pin and the reamer hole, the same effect can also be acquired in a horizontal-axis machine.

According to one aspect of the refrigerant compressor of the present invention, at least one of the diameter space between the upper fitting surface of the guide frame and the upper fitting surface of the compliant frame at the upper fitting part where the upper fitting surface of the guide frame contacts with the upper fitting surface of the compliant frame, and the diameter space between the lower fitting surface of the guide frame and the lower fitting surface of the compliant frame at the lower fitting part where the lower fitting surface of the guide frame contacts with the lower fitting surface of the compliant frame is set to be equal to or shorter than the diameter space between the rotor and the stator. According to one aspect of the refrigerant compressor of the present invention, the distance (eccentric amount) between the orbiting axial part of the main shaft and the center of the main shaft is set to be greater than an orbiting radius specified by the forms of the spiral blade of the fixed scroll and the orbiting scroll, and set to be within the range not exceeding a half of a sum of three clearances of a diameter clearance of the orbiting bearing, a diameter clearance of the main bearing, and a minimum diameter clearance of the fitting surface of the compliant frame and the guide frame. According to one aspect of the refrigerant compressor of the present invention, the guide frame has two contact surfaces which independently exist, that is the upper fitting surface and the lower fitting surface, on an internal circumference of the guide frame, which are formed to be contacted with each of the two contact surfaces of the compliant frame, and the guide frame supports the compliant frame in the radial direction at the two contact surfaces. Further, a plane is provided in the radial direction between the upper fitting surface and the lower fitting surface of the guide frame, a reamer hole is provided on this plane, and a reamer pin is inserted into the reamer hole. A plane is also provided in the radial direction between the upper fitting surface and the lower fitting surface of the compliant frame, and another reamer hole is provided on the plane facing the reamer hole of the guide frame. The rotation prevention structure which regulates a rotation of the compliant frame by being interlocked with the reamer pin inserted in the guide frame is composed of combination of the reamer pin and the reamer holes. The diameter clearance of the reamer pin and the reamer hole at the contact part is set to be larger than the maximum diameter clearance at the upper or lower fitting surfaces of the compliant frame and the guide frame.

According to one aspect of the refrigerant compressor of the present invention, one end of the reamer pin is firmly pressed into a reamer hole in either the compliant frame or the guide frame, and the diameter space between the reamer hole and the other end of the reamer pin, where this end of the reamer pin is not pressed but inserted into another reamer hole in another plane facing the plane of the pressed reamer hole is set to be larger than the maximum diameter space at the upper and the lower fitting parts of the compliant frame and the guide frame where the upper or the lower fitting surface of the compliant frame contacts with the upper or the lower fitting surface of the guide frame. According to the refrigerant compressor of the present invention, the rotation prevention structure of the compliant frame is composed of combination of a pair of a reamer pin and reamer holes.

According to one aspect of the scroll compressor of the present invention, as stated above, since at least one of the upper and the lower diameter spaces at the fitting parts where the upper or the lower fitting surface of the compliant frame contacts with the upper or the lower fitting surface of the guide frame is set to be equal to or shorter than the diameter space being a length difference between the external diameter of the rotor and the internal diameter of the stator, it is possible to obtain the scroll compressor of high performance where the external diameter of the rotor does not contact with the internal diameter of the stator when the axis of the rotor inserted in the main shaft moves by the movement of the compliant frame and little is leaked from the side of the spiral blade.

According to one aspect of the scroll compressor of the present invention, the distance (eccentric amount) between the center of the orbiting axial part of the main shaft and the center of the main shaft is set to be greater than an orbiting radius specified by the forms of the spiral blade of the fixed scroll and the orbiting scroll, and set to be within the range not exceeding a half of a sum of three clearances of a diameter clearance of the orbiting bearing, a diameter clearance of the main bearing, and a minimum diameter clearance at the fitting surface of the compliant frame and the guide frame. Therefore, it is possible to reduce the increase of the spiral side space between the orbiting scroll and the fixed scroll even when orbiting scroll moves in the radial direction based on the clearance at the fitting surface of the compliant frame and the guide frame. Thus, the scroll compressor of high performance can be obtained.

According to one aspect of the scroll compressor of the present invention, the space between the upper fitting surface of the guide frame and the upper fitting surface of the compliant frame at the upper fitting part where the upper fitting surface of the guide frame contacts with the upper fitting surface of the compliant frame is set to be smaller than the space between the lower fitting surface of the guide frame and the lower fitting surface of the compliant frame at the lower fitting part where the lower fitting surface of the guide frame contacts with the lower fitting surface of the compliant frame. Therefore, the scroll compressor of high reliability and high performance where the contact force of the spiral blade point is little and wear of the point is also little, can be obtained.

According to one aspect of the scroll compressor of the present invention, the rotation prevention structure which regulates a rotation of the compliant frame by being interlocked with the reamer pin inserted in the guide frame is composed of combination of the reamer pin and the reamer holes, and the diameter clearance of the reamer pin and the reamer hole at the contact part is set to be larger than the maximum diameter clearance at the upper or the lower fitting surface of the compliant frame and the guide frame. Therefore, it is possible to avoid the problems that the state of the reamer pin supporting all the gas compression load during operation occurs, an excessive force is loaded on the reamer pin and the reamer holes, which causes a wear increase, or that performance is fallen and noise is increased because the action of the orbiting scroll becomes unstable because of the movement of the contact point of the fitting surface of the compliant frame becoming discontinuous. Thus, the scroll compressor of high performance and high reliability can be obtained.

According to one aspect of the scroll compressor of the present invention, one end of the reamer pin is firmly pressed into a reamer hole in either the compliant frame or the guide frame, and the diameter space between the reamer hole and the other end of the reamer pin, where this end of the reamer pin is not pressed but inserted into another reamer hole in another plane facing the plane of the pressed reamer hole is set to be larger than the maximum diameter space at the upper and the lower fitting parts of the compliant frame and the guide frame where the upper or the lower fitting surface of the compliant frame contacts with the upper or the lower fitting surface of the guide frame. Since the reamer pin does not incline during operation, a slanting contact of the reamer pin partially contacting the reamer hole can be prevented. Thus, the scroll compressor of high reliability having little wear of the reamer pin and the reamer hole can be obtained.

According to one aspect of the scroll compressor of the present invention, the rotation prevention structure of the compliant frame is composed of combination of a pair of a reamer pin and reamer holes, the discontinuous movement of the contact point in the radial direction of the reamer pin and the reamer hole can be minimized. Therefore, the scroll compressor of high performance and low noise where the action of the compliant frame is stabilized can be obtained.

EFFECTS OF THE INVENTION

A scroll compressor according to one aspect of the present invention includes the following:

a fixed scroll provided in a hermetic container, having a spiral blade on a seat, an orbiting scroll provided in the hermetic container, having a spiral blade on a seat, where the spiral blade of the orbiting scroll forms a compression chamber by being together with the spiral blade of the fixed scroll, a motor provided in the hermetic container, having a rotor connected to a main shaft for rotating the orbiting scroll and a stator for giving a rotation force to the rotor, a compliant frame provided in the hermetic container, having a thrust bearing for supporting the orbiting scroll in the axial direction, and a main bearing for supporting the main shaft in the radial direction which drives the orbiting scroll, and a guide frame provided in the hermetic container, having an internal circumferential side contact surface and an external circumferential side contact surface, for supporting a contact surface of the compliant frame in the radial direction at the internal circumferential side contact surface which contacts with the contact surface of the compliant frame, with having a space between the contact surface of the compliant frame and the internal circumferential side contact surface of the guide frame, wherein the space between the contact surface of the compliant frame and the internal circumferential side contact surface of the guide frame is set to be equal to or shorter than a space being a length difference between an external diameter of the rotor and an internal diameter of the stator. Thus, a scroll compressor of high reliability whose structure is simple to be mass-produced can be obtained.

A scroll compressor according to one aspect of the present invention includes the following:

a fixed scroll provided in a hermetic container, having a spiral blade on a seat, an orbiting scroll provided in the hermetic container, having a spiral blade on a seat, where the spiral blade of the orbiting scroll forms a compression chamber by being together with the spiral blade of the fixed scroll, a motor provided in the hermetic container, having a stator and a rotor for giving a rotation force to a main shaft which drives the orbiting scroll, a compliant frame provided in the hermetic container, having a thrust bearing for supporting the orbiting scroll in the axial direction, a main bearing for supporting the main shaft in the radial direction, and two contact surfaces which independently exist, that is a first fitting surface and a second fitting surface, on an external circumference of the compliant frame, a guide frame provided in the hermetic container, having two contact surfaces which independently exist, that is a first fitting surface and a second fitting surface, on an internal circumference of the guide frame, which are formed to be contacted with each of the two contact surfaces of the compliant frame, and the guide frame supporting the compliant frame in the radial direction at the two contact surfaces, a first space existing at a first contact part where the first fitting surface of the guide frame contacts with the first fitting surface of the compliant frame, and a second space existing at a second contact part where the second fitting surface of the guide frame contacts with the second fitting surface of the compliant frame, wherein at least one of the first space and the second space is set to be equal to or shorter than a space being a length difference between an external diameter of the rotor and an internal diameter of the stator. Thus, a scroll compressor of high performance which can retain stable operations can be obtained.

A scroll compressor according to one aspect of the present invention further includes an orbiting axial part provided on the main shaft and an orbiting bearing provided on the orbiting scroll which transmits rotation to the orbiting axial part of the main shaft, wherein the orbiting axial part of the main shaft has its center off from the center of the main shaft, and an eccentric amount which is a distance between the center of the orbiting axial part and the center of the main shaft is set to be greater than an orbiting radius specified by forms of the spiral blade of the fixed scroll and the orbiting scroll, and set to be within a range not exceeding a half of a sum of three clearances of a diameter clearance of the orbiting bearing, a diameter clearance of the main bearing, and a minimum diameter clearance at the contact surface of the compliant frame and the guide frame. Thus, a scroll compressor which can retain high quality and high performance in mass-production can be obtained.

In a scroll compressor according to one aspect of the present invention, the first space at the first contact part where the first fitting surface of the guide frame contacts with the first fitting surface of the compliant frame is set to be shorter than the second space at the second contact part located closer to the motor than the first contact part, where the second fitting surface of the guide frame contacts with the second fitting surface of the compliant frame. Thus, a scroll compressor, in which high performance can be retained without making an excessive contact force of the spiral blade and which is easy to be mass-produced, can be obtained.

A scroll compressor according to one aspect of the present invention includes the following:

a fixed scroll provided in a hermetic container, having a spiral blade on a seat, an orbiting scroll provided in the hermetic container, having a spiral blade on a seat, where the spiral blade of the orbiting scroll forms a compression chamber by being together with the spiral blade of the fixed scroll, a motor provided in the hermetic container, having a rotor connected to a main shaft for rotating the orbiting scroll and a stator for giving a rotation force to the rotor, a compliant frame provided in the hermetic container, having a thrust bearing for supporting the orbiting scroll in the axial direction and a main bearing for supporting the main shaft in the radial direction which rotates the orbiting scroll, a guide frame provided in the hermetic container, having a contact surface which contacts with a contact surface of the compliant frame, for supporting the compliant frame by contacting the contact surface of the guide frame with the contact surface of the compliant frame, and a reamer pin provided in the hermetic container, having two ends one of which is inserted in a reamer hole located close to the contact surface and provided in at least one of the compliant frame and the guide frame, for preventing a rotation of the compliant frame by being contacted with the other of the compliant frame and the guide frame, and the reamer pin having a space between the reamer pin and the reamer hole at a contact part where the reamer pin contacts with the reamer hole, wherein the space between the reamer pin and the reamer hole at the contact part is set to be longer than a space between the contact surface of the guide frame and the contact surface of the compliant frame. Thus, a scroll compressor which can retain stable operations in the long run can be obtained.

A scroll compressor according to one aspect of the present invention includes the following:

a fixed scroll provided in a hermetic container, having a spiral blade on a seat, an orbiting scroll provided in the hermetic container, having a spiral blade on a seat, where the spiral blade of the orbiting scroll forms a compression chamber by being together with the spiral blade of the fixed scroll, a motor provided in the hermetic container, having a stator and a rotor for giving a rotation force to a main shaft which drives the orbiting scroll, a compliant frame provided in the hermetic container, having a thrust bearing for supporting the orbiting scroll in the axial direction, a main bearing for supporting the main shaft in the radial direction, and two contact surfaces which independently exist, that is a first fitting surface and a second fitting surface, on an external circumference of the compliant frame, a guide frame provided in the hermetic container, having two contact surfaces which independently exist, that is a first fitting surface and a second fitting surface, on an internal circumference of the guide frame, which are formed to be contacted with each of the two contact surfaces of the compliant frame, and the guide frame supporting the compliant frame in the radial direction at the two contact surfaces, a first space existing at a first contact part where the first fitting surface of the guide frame contacts with the first fitting surface of the compliant frame, a second space existing at a second contact part where the second fitting surface of the guide frame contacts with the second fitting surface of the compliant frame, a reamer pin provided in the hermetic container, having two ends, and a reamer hole provided on at least one of a guide frame plane in the radial direction between the first fitting surface and the second fitting surface of the guide frame and a compliant frame plane in the radial direction between the first fitting surface and the second fitting surface of the compliant frame, wherein one of the two ends of the reamer pin is inserted in the reamer hole for preventing rotation of the compliant frame, and a space between the reamer pin and the reamer hole at a contact part where the reamer pin contacts with the reamer hole is set to be longer than each of the first space and the second space between the guide frame and the compliant frame. Thus, a scroll compressor of high performance and high reliability can be obtained.

In a scroll compressor according to one aspect of the present invention, one of the two ends of the reamer pin is fixed to either the compliant frame or the guide frame, the other of the two ends is inserted in the reamer hole in the other of the compliant frame and the guide frame where the reamer hole is provided, and a space between the reamer hole and the reamer pin which is not fixed is set to be longer than the space between the contact surface of the compliant frame and the contact surface of the guide frame. Thus, a scroll compressor of high reliability in which little single side contact and little wear is generated during operation can be obtained.

In a scroll compressor according to one aspect of the present invention, at least one reamer pin is provided. Thus, it is possible to obtain a scroll compressor in which an irregular action can be suppressed.

Having thus described several particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only, and not intended to be limiting. The invention is limited only as defined in the following claims and the equivalents thereto.

What is claimed is:

1. A scroll compressor comprising:

a fixed scroll provided in a hermetic container, having a spiral blade on a seat;

an orbiting scroll provided in the hermetic container, having a spiral blade on a seat, where the spiral blade of the orbiting scroll forms a compression chamber by being together with the spiral blade of the fixed scroll;

a motor provided in the hermetic container, having a rotor connected to a main shaft for rotating the orbiting scroll and a stator for giving a rotation force to the rotor;

a compliant frame provided in the hermetic container, having a thrust bearing for supporting the orbiting scroll in an axial direction, and a main bearing for supporting the main shaft in a radial direction which drives the orbiting scroll; and a guide frame provided in the hermetic container, having an internal circumferential side contact surface and an external circumferential side contact surface, for supporting a contact surface of the compliant frame in the radial direction at the internal circumferential side contact surface which contacts with the contact surface of the compliant frame, with having a space between the contact surface of the compliant frame and the internal circumferential side contact surface of the guide frame, wherein the space between the contact surface of the compliant frame and the internal circumferential side contact surface of the guide frame is set to be equal to or shorter than a space being a length difference between an external diameter of the rotor and an internal diameter of the stator.

2. The scroll compressor of claim 1, further including an orbiting axial part provided on the main shaft and an orbiting bearing provided on the orbiting scroll which transmits rotation to the orbiting axial part of the main shaft, wherein the orbiting axial part of the main shaft has its center off from a center of the main shaft, and an eccentric amount which is a distance between the center of the orbiting axial part and the center of the main shaft is set to be greater than an orbiting radius specified by forms of the spiral blade of the fixed scroll and the orbiting scroll, and set to be within a range not exceeding a half of a sum of three clearances of a diameter clearance of the orbiting bearing, a diameter clearance of the main bearing, and a minimum diameter clearance at the contact surface of the compliant frame and the guide frame.

3. A scroll compressor comprising:

a fixed scroll provided in a hermetic container, having a spiral blade on a seat;

an orbiting scroll provided in the hermetic container, having a spiral blade on a seat, where the spiral blade of the orbiting scroll forms a compression chamber by being together with the spiral blade of the fixed scroll;

a motor provided in the hermetic container, having a stator and a rotor for giving a rotation force to a main shaft which drives the orbiting scroll;

a compliant frame provided in the hermetic container, having a thrust bearing for supporting the orbiting scroll in an axial direction, a main bearing for supporting the main shaft in a radial direction, and two contact surfaces which independently exist, that is a first fitting surface and a second fitting surface, on an external circumference of the compliant frame;

a guide frame provided in the hermetic container, having two contact surfaces which independently exist, that is a first fitting surface and a second fitting surface, on an internal circumference of the guide frame, which are formed to be contacted with each of the two contact surfaces of the compliant frame, and the guide frame supporting the compliant frame in the radial direction at the two contact surfaces;

a first space existing at a first contact part where the first fitting surface of the guide frame contacts with the first fitting surface of the compliant frame; and a second space existing at a second contact part where the second fitting surface of the guide frame contacts with the second fitting surface of the compliant frame, wherein at least one of the first space and the second space is set to be equal to or shorter than a space being a length difference between an external diameter of the rotor and an internal diameter of the stator.

4. The scroll compressor of claim 3, wherein the first space at the first contact part where the first fitting surface of the guide frame contacts with the first fitting surface of the compliant frame is set to be shorter than the second space at the second contact part located closer to the motor than the first contact part, where the second fitting surface of the guide frame contacts with the second fitting surface of the compliant frame.

5. The scroll compressor of claim 3, further including an orbiting axial part provided on the main shaft and an orbiting bearing provided on the orbiting scroll which transmits rotation to the orbiting axial part of the main shaft, wherein the orbiting axial part of the main shaft has its center off from a center of the main shaft, and an eccentric amount which is a distance between the center of the orbiting axial part and the center of the main shaft is set to be greater than an orbiting radius specified by forms of the spiral blade of the fixed scroll and the orbiting scroll, and set to be within a range not exceeding a half of a sum of three clearances of a diameter clearance of the orbiting bearing, a diameter clearance of the main bearing, and a minimum diameter clearance at the contact surface of the compliant frame and the guide frame.

6. A scroll compressor comprising:

a fixed scroll provided in a hermetic container, having a spiral blade on a seat;

an orbiting scroll provided in the hermetic container, having a spiral blade on a seat, where the spiral blade of the orbiting scroll forms a compression chamber by being together with the spiral blade of the fixed scroll;

a motor provided in the hermetic container, having a rotor connected to a main shaft for rotating the orbiting scroll and a stator for giving a rotation force to the rotor;

a compliant frame provided in the hermetic container, having a thrust bearing for supporting the orbiting scroll in an axial direction and a main bearing for supporting the main shaft in a radial direction which rotates the orbiting scroll;

a guide frame provided in the hermetic container, having a contact surface which contacts with a contact surface of the compliant frame, for supporting the compliant frame by contacting the contact surface of the guide frame with the contact surface of the compliant frame; and a reamer pin provided in the hermetic container, having two ends one of which is inserted in a reamer hole located close to the contact surface and provided in at least one of the compliant frame and the guide frame, for preventing a rotation of the compliant frame by being contacted with the other of the compliant frame and the guide frame, and the reamer pin having a space between the reamer pin and the reamer hole at a contact part where the reamer pin contacts with the reamer hole, wherein the space between the reamer pin and the reamer hole at the contact part is set to be longer than a space between the contact surface of the guide frame and the contact surface of the compliant frame.

7. The scroll compressor of claim 6, wherein at least one reamer pin is provided.

8. The scroll compressor of claim 6, wherein one of the two ends of the reamer pin is fixed to one of the compliant frame and the guide frame, the other of the two ends is inserted in the reamer hole in the other of the compliant frame and the guide frame where the reamer hole is provided, and a space between the reamer hole and the reamer pin which is not fixed is set to be longer than the space between the contact surface of the compliant frame and the contact surface of the guide frame.

9. The scroll compressor of claim 8, wherein at least one reamer pin is provided.

10. A scroll compressor comprising:

a fixed scroll provided in a hermetic container, having a spiral blade on a seat;

an orbiting scroll provided in the hermetic container, having a spiral blade on a seat, where the spiral blade of the orbiting scroll forms a compression chamber by being together with the spiral blade of the fixed scroll;

a motor provided in the hermetic container, having a stator and a rotor for giving a rotation force to a main shaft which drives the orbiting scroll;

a compliant frame provided in the hermetic container, having a thrust bearing for supporting the orbiting scroll in an axial direction, a main bearing for supporting the main shaft in a radial direction, and two contact surfaces which independently exist, that is a first fitting surface and a second fitting surface, on an external circumference of the compliant frame;

a guide frame provided in the hermetic container, having two contact surfaces which independently exist, that is a first fitting surface and a second fitting surface, on an internal circumference of the guide frame, which are formed to be contacted with each of the two contact surfaces of the compliant frame, and the guide frame supporting the compliant frame in the radial direction at the two contact surfaces;

a first space existing at a first contact part where the first fitting surface of the guide frame contacts with the first fitting surface of the compliant frame;

a second space existing at a second contact part where the second fitting surface of the guide frame contacts with the second fitting surface of the compliant frame;

a reamer pin provided in the hermetic container; having two ends; and a reamer hole provided on at least one of a guide frame plane in the radial direction between the first fitting surface and the second fitting surface of the guide frame and a compliant frame plane in the radial direction between the first fitting surface and the second fitting surface of the compliant frame, wherein one of the two ends of the reamer pin is inserted in the reamer hole for preventing rotation of the compliant frame, and a space between the reamer pin and the reamer hole at a contact part where the reamer pin contacts with the reamer hole is set to be longer than each of the first space and the second space between the guide frame and the compliant frame.

11. The scroll compressor of claim 10, wherein one of the two ends of the reamer pin is fixed to one of the compliant frame and the guide frame, the other of the two ends is inserted in the reamer hole in the other of the compliant frame and the guide frame where the reamer hole is provided, and a space between the reamer hole and the reamer pin which is not fixed is set to be longer than the space between the contact surface of the compliant frame and the contact surface of the guide frame.

12. The scroll compressor of claim 10, wherein at least one reamer pin is provided.

* * * * *

UNITED STATES PATENT AND TRADEMARK OFFICE

CERTIFICATE OF CORRECTION

PATENT NO. : 6,582,210 B2
DATED : June 24, 2003
INVENTOR(S) : Sano et al.

It is certified that error appears in the above-identified patent and that said Letters Patent is hereby corrected as shown below:

Column 9,
Line 12, change “a” to -- α --.

Column 13,
Line 27, change “degree” to -- degrees --.

Signed and Sealed this

Second Day of March, 2004

JON W. DUDAS
*Acting Director of the United States Patent and Trademark Office*